US005437476A

United States Patent [19]

Hutchinson

[11] Patent Number: 5,437,476

[45] Date of Patent: Aug. 1, 1995

[54] MULTIPAGE BOUND BOOKLET HAVING PRESSURE SEALED BINDING

[75] Inventor: Wilbur Hutchinson, Mt. Prospect, Ill.

[73] Assignee: Moore Business Forms, Inc., Grand Island, N.Y.

[21] Appl. No.: 45,221

[22] Filed: Apr. 13, 1993

[51] Int. Cl.[6] ..... B42D 1/00

[52] U.S. Cl. ..... 281/151; 281/21.1; 281/38; 281/12

[58] Field of Search ..... 281/2, 3.1, 5, 9, 10, 281/12, 15.1, 21.1, 16; 462/900

[56] References Cited

U.S. PATENT DOCUMENTS

| | | | |
|---|---|---|---|
| 2,314,087 | 3/1943 | Heller | 270/37 |
| 3,718,277 | 2/1973 | Volkert | 229/73 |
| 3,858,792 | 1/1975 | Volkert | 229/73 |
| 3,883,069 | 5/1975 | Volkert | 229/73 |
| 4,213,220 | 7/1980 | Lopez-Martinez | 11/1 R |
| 4,229,926 | 10/1980 | Rowling | 53/429 |
| 4,525,116 | 6/1985 | Holmberg | 412/8 |
| 4,534,581 | 8/1985 | Engh | 281/15 R |
| 4,618,520 | 10/1986 | Holmberg | 428/131 |
| 4,673,324 | 6/1987 | Hanson et al. | 281/21.1 X |
| 4,789,187 | 12/1988 | Corlew et al. | 281/15 R |
| 4,832,372 | 5/1989 | Young | 281/31 |
| 4,842,303 | 6/1989 | Molenda | 281/38 |
| 4,911,475 | 3/1990 | Lerman | 281/15.1 |
| 4,975,011 | 12/1990 | Holmberg | 412/6 |
| 5,002,447 | 3/1991 | Borel | 412/6 |
| 5,015,137 | 5/1991 | Stenner | 412/1 |
| 5,018,765 | 5/1991 | Barnette | 281/15.001 |
| 5,050,909 | 9/1991 | Mertens et al. | 281/16 X |
| 5,078,563 | 1/1992 | Lolli | 412/8 |
| 5,153,041 | 10/1992 | Clements et al. | 281/15.1 X |
| 5,190,316 | 3/1993 | Hefty | 281/15.1 |
| 5,193,851 | 3/1993 | Honegger | 281/15.1 |

*Primary Examiner*—Willmon Fridie
*Attorney, Agent, or Firm*—Nixon & Vanderhye

[57] ABSTRACT

An apparatus and method for binding booklets using pressure seal adhesive patterns. Paper sheets having adhesive strips along their centerfold lines are assembled and folded together. A pressure sealing device activates the adhesive strips and causes the adhesive to bind the folded sheets together into a booklet. The adhesive strips are arranged on the sheets parallel on both sides of the centerfold line of the sheet. The sheets are assembled so that adhesive strips are juxtaposed against the adhesive strips on adjacent sheets. The assembly is folded and a pressure sealer device seals the adhesive strips together to bind the sheets into a booklet.

9 Claims, 2 Drawing Sheets

MULTIPAGE BOUND BOOKLET HAVING PRESSURE SEALED BINDING

FIELD OF THE INVENTION

The invention relates to binding and, in particular, to binding pamphlets, brochures, books, magazines, newsletters, mailers and other similar materials. The invention is specifically related to binding multipage materials with adhesives and pressure seal techniques.

BACKGROUND OF THE INVENTION

Pamphlets, brochures, books, magazines, newsletters, mailers and other similar materials (collectively referred to as booklets) have conventionally been bound by staple:s, saddle stitches and other conventional binding techniques. Each sheet of the booklet is typically the width of two booklet pages. Printing text on the front and back of a sheet allows each sheet to serve as four printed pages of the booklet. The printed sheets are collated and assembled. The assembly of sheets are bound with staples or stitching and folded into a booklet.

Book binding is expensive. Traditional books are bound with elaborate stitching in the spine of a hard backed book covers. Less expensive techniques, such as stapling, have been developed. For example, magazines are stapled instead of being stitched. However, even these less expensive binding techniques are prohibitively expensive for certain applications, such as high volume mailers.

Promotional mailers, multipage invoices and other similar materials are produced at extraordinarily low costs. High speed document handling devices cut, fold and seal paper rolls and sheets to produce such mailers and similar materials. There has been a long felt need for a method to bind these low-cost materials together into booklets. Stapling and other traditional. binding techniques have proven to be expensive and difficult. For example, stapling devices tend to breakdown and staples add weight to the booklet and increase the postage cost of the mailer. Accordingly, the need for very low cost binding methods was left unsatisfied until the current invention.

SUMMARY OF THE INVENTION

The current invention is an apparatus and method for binding booklets. Paper sheets having pressure seal adhesive strips along their centerfold lines are assembled and folded together. These pressure seal strips are not sticky until activated by pressure. A pressure sealing device activates the adhesive strips. The activated adhesives bind the folded sheets together into a booklet, such as by applying a pressure of 100–200 pounds per linear inch. The adhesive strips are arranged on the sheets parallel to the centerfold line and on both sides of each sheet. The sheets are assembled so that adhesive strips are juxtaposed against the adhesive strips on adjacent sheets. The assembly is folded and a pressure sealer device seals the adhesive strips together to bind the sheets in a booklet.

In one embodiment, the invention is a booklet comprising: (1) at least one outer sheet folded along a fold line and a first inner adhesive pattern adjacent to the fold line, (2) at least one inner sheet nested in the outer sheet, the inner sheet folded along a fold line and having an outer adhesive pattern juxtaposed with the first inner adhesive pattern of the outer sheet, and (3) juxtaposed adhesive patterns binding said sheets.

In another embodiment, the invention is a method for forming a booklet having a plurality of folded sheets: nested together wherein each sheet has a pressure seal adhesive pattern offset from the fold line and on both sides of the sheet, and the adhesive pattern on one side of the sheet does not overlap the adhesive pattern on the other side of the sheet, and using sheet feeders, accumulators, and folders, where the method comprises:

a. printing information of the pages to be formed from the sheets having the adhesive pattern,
b. loading stacks of preprinted sheets having the adhesive pattern in a first orientation in a first sheet feeder and loading stacks of preprinted sheets having a second orientation in a second sheet feeder,
c. feeding at least one sheet into each accumulator from each sheet feeder such that the fold line on each sheet is aligned over an outlet slot in each accumulator,
d. folding each sheet along the fold line and pushing the sheets through the outlet slot of an accumulator,
e. nesting an inner sheet into an outer sheet by inserting a folded sheet from one accumulator into an outer sheet being folded and pushed through a second accumulator wherein the adhesive patterns on each sheet are juxtaposed with adhesive patterns on adjacent sheets, and
f. binding the booklet by pressure sealing the juxtaposed adhesive patterns.

DETAILED DESCRIPTION OF THE DRAWINGS

Figure 1:
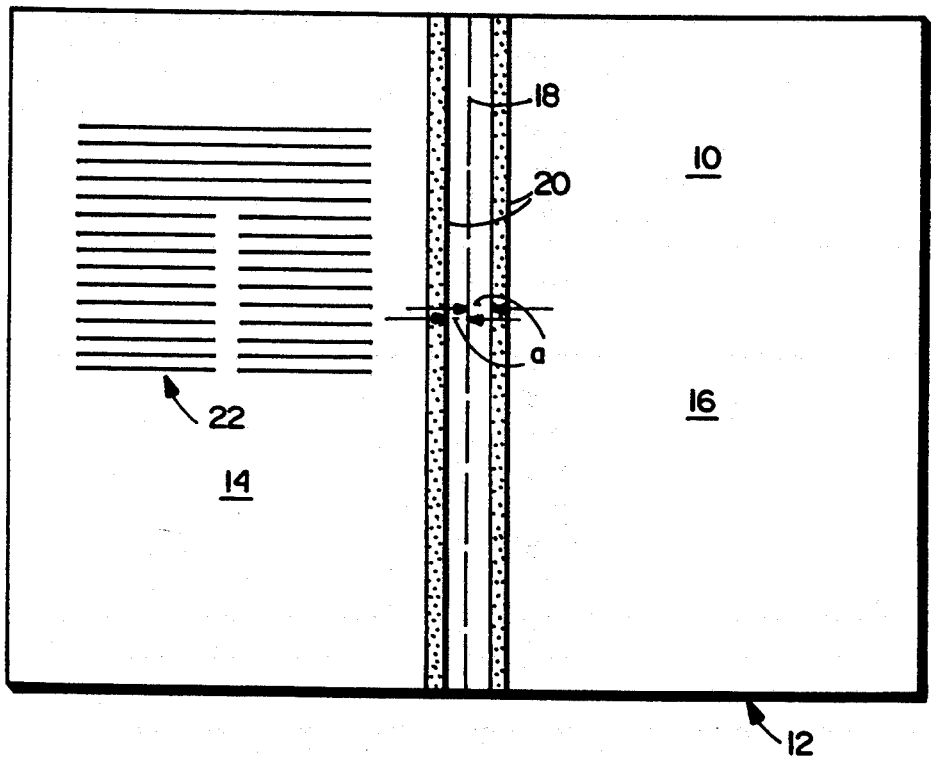
FIG. 1 illustrates the front side of a sheet having adhesive strips along a perforated fold line in accordance with one embodiment of the invention.

FIG. 1 shows the front 10 of a sheet 12 of paper. The sheet is sectioned into left-hand 14 and right-hand 16 sides by a fold line 18. The fold line may be perforated to assist in the subsequent folding operation. A pail of adhesive strips 20 are parallel to and on both sides of the fold line 18. Both adhesive strips are located at an equal distance "a" from the fold line 18.

The adhesive strips are, in the preferred embodiment, formed of pressure seal adhesives. Pressure seal adhesives adhere only when pressed under sufficient pressure and in contact with another pressure seal adhesive coated surface. In addition, pressure seal adhesives bond dry. They do not form a glue residue that can clog paper handling equipment. However, other types of adhesives, such as heat activated types, may be employed in the formation of booklets. In addition, the adhesive strips need not be continuous and may be staggered, dotted or in some other arrangement. The adhesive strips and perforated fold line may be preformed and sold as booklet sheet stock to printing customers. Text and graphics 22 are printed by the seller and/or customer on the left and right sides of the sheet 12.

Conventional non-impact printers are particularly useful for printing on sheets having pressure seal adhesives.

Figure 2:
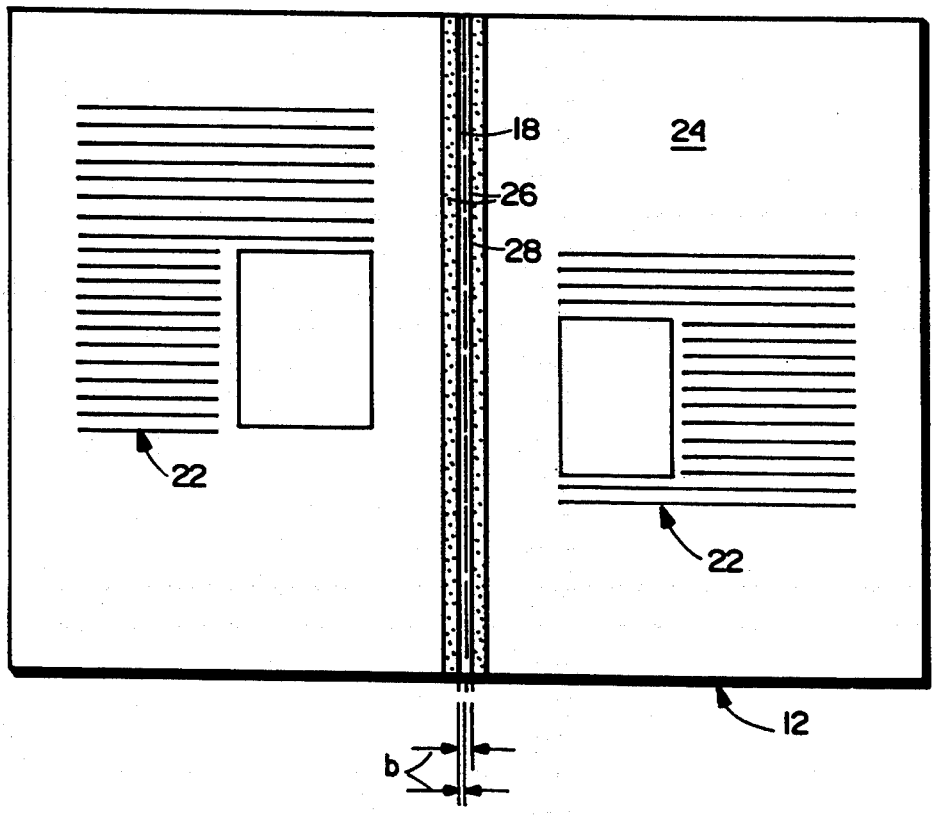
FIG. 2 illustrates the back side of the sheet shown in FIG. 1.

As shown in FIG. 2, the back 24 of sheet 12 may also be used to print text and graphics 22. As with the front of sheet, the back is separated into two pages along fold line 18. A pair of pressure seal adhesive strips 26 are parallel to and spaced a distance "b" from the fold line. In one embodiment of the booklet, the adhesive. strips on the back of the sheet are distanced from the fold line so as not to overlap the adhesive strip on the front. For example, the distance "a" separating the front adhesive strips from the fold line is at least as great as the distance between the fold line and the outside edge 28 of the adhesive strips on the back of the sheet. There are alternative arrangements of adhesive strips, such as broken strips and adhesive dots, which can be arranged to not overlap with the adhesive on the opposite side of the sheet without the need for staggered off-sets from the fold line.

Figure 3:
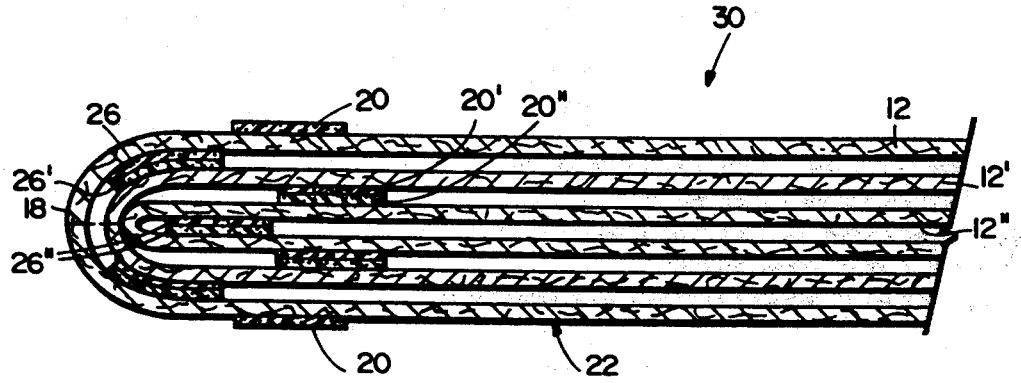
FIG. 3 illustrates a side view of collated and folded sheets such as the type shown in FIG. 1.

FIG. 3 shows an assembled booklet 30 of three sheets 12, 12' and 12". The sheets are folded along fold line 18 such that the there are twelve pages in the booklet. Each page is one-half sheet in area and on one side of a sheet. The number of pages in the booklet is variable, depends on the number of sheets, and can be selected based upon the intended use for the booklet. The text and graphics 22 on each page of the booklet is preprinted before the sheets are assembled into the booklet. However, text and graphics, e.g., individual names and addresses, may be printed on the outside pages of the booklet after the booklet has been bound.

The booklet 30 is bound by activating the pressure seal adhesive strips. The sheets to the booklet are arranged such that the adhesive strips of adjacent pages are juxtaposed. For example, the adhesive strip 26 on sheet 12 is juxtaposed with the adhesive strip 26' sheet 12'. Similarly, the adhesive strip 20' on sheet 12' is face-to-face with the strip 20" of sheet 12". For the center sheet 12", the pair of adhesive strips 26" are folded on top of one another to adhere to each other. The juxtaposed adhesive strips adhere together to bind the booklet.

The adhesive strips 20 on the outside of the booklet do not adhere. The adhesive strips are activated when in contact with another adhesive and subjected to an appropriate sealing pressure. The adhesive strips on the outside of the booklet are not in contact with other adhesive strips. Accordingly, the outside adhesive 20 should not cling to other booklets or papers in contact with the outside of the booklet.

Figure 4:
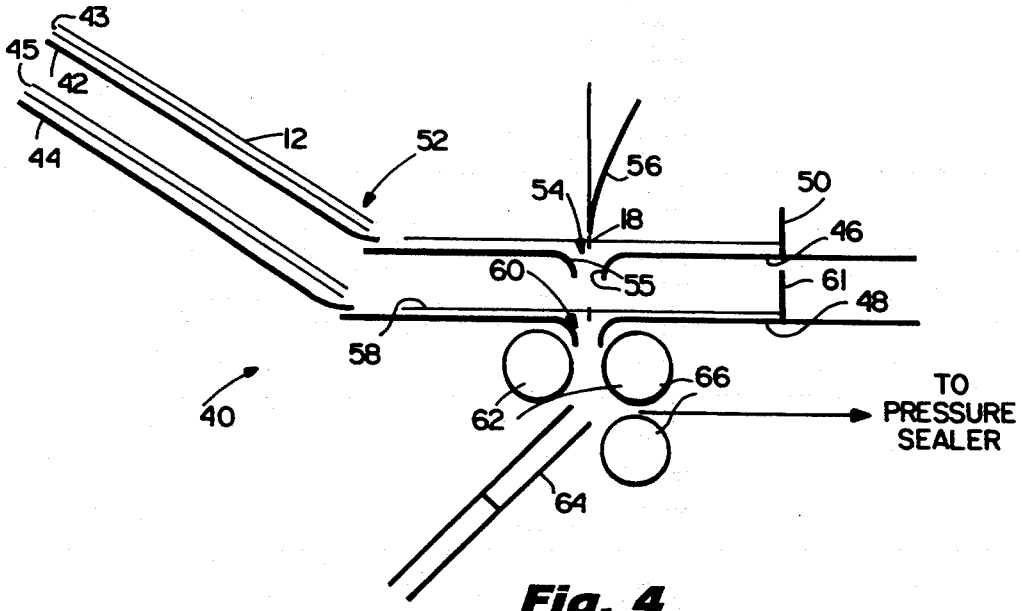
FIG. 4 is a schematic diagram of a device for collating, folding and sealing a booklet formed of sheets such as shown in FIG. 1.

FIG. 4 shows a schematic diagram of a collating device 40 for collating, folding and sealing a booklet. The collating device includes sheet feeders 42, 44, accumulators 46, 48 and a knife folder 56. The first sheet feeder 42 holds a stack 43 of preprinted sheets 12 wherein the adhesive strips on each sheet are oriented similarly. The second sheet feeder 44 which may be below the first sheet feeder has a stack 45 of sheets in which the adhesive strips are oriented similarly but opposite to the orientation of sheets in the first sheet feeder. Under computer control, individual sheets are feed alternatively from the two sheet feeders to the accumulators.

The first accumulator 46 receives individual sheets 12 from the first sheet feeder 42. An adjustable stop 50 opposite to the sheet inlet 52 aligns each sheet in the accumulator. An outlet slot 54 near the centerline of the accumulator is provided with rounded edges 55 to assist in the folding of each sheet as it exits the accumulator. When aligned in the accumulator, the fold line 18 of each sheet overlies the outlet slot 54. A knife-edge folder 56 presses the sheet downward along the fold line through the slot in the accumulator. As the sheet moves through the outlet slot, the sheet is folded along-the fold line and moves towards the fold line of the sheet 58 in the second accumulator 48.

The second accumulator 48 is below the first accumulator such that the outlet slot 54 of the first accumulator is in vertical alignment with outlet slot 60 of the second accumulator. Sheets from the second sheet feeder 44 move into the second accumulator and are stopped by an adjustable stop 61. Each sheet, when properly aligned in the second accumulator, has its fold line aligned over slot 60 in a similar manner to the alignment of sheets in the first accumulator 46. The knife-edge folder 56 pushes the folded sheet from the first accumulator down onto the fold line of the sheet in the second accumulator. The knife edge folder continues to push the first and second sheet through the outlet slot 60 of the second accumulator. As the knife edge folder moves through the slot 60, the sheet from the first accumulator nests into the folding sheet in the second accumulator. The adhesive strips on the pair of nested sheets are aligned because the opposing adhesive patterns on the sheets.

A pair of rollers 62 immediately below the outlet slot 60 to the second accumulator pulls the nested and folded sheets into a receptacle 64. The nested sheets are routed from the receptacle through rollers 66 to a pressure sealer. The pressure sealer applies an appropriate sealing pressure, e.g., 100 to 200 pounds per linear inch, to activate the adhesive strips on the sheets. The activated juxtaposed adhesive strips seal together the sheets and bind the booklet. Alternatively, the booklet may be processed further, such as by insertion into a mailer, before the sheets are sealed together.

If more than a four page booklet is desired, then the number of accumulators can be increased beyond the two shown in FIG. 4. Alternatively, the stacks of sheets loaded in each of the sheet feeders 42, 44 can be arranged such that the adhesive pattern is reversed with each sheet in a stack. Similarly, instead of a single sheet being loaded into each accumulator, a pair of sheets are loaded with opposing adhesive strips into each accumulator to form booklets with more than two sheets formed using just two accumulators. Moreover, by pre-collating the sheets placed in the sheet feeders, custom pre-printed pages and custom adhesive patterns may be employed to form customized booklets and other self-mailers.

The invention has been described in its currently preferred embodiment. The invention is not limited to this embodiment. Rather, the invention covers a variety of modifications and changes within the terms and spirit of the attached claims.

What is claimed is:

1. A booklet comprising:

at least one outer sheet folded along an outer fold line and having a first inner pressurized adhesive pattern adjacent to said outer fold line, and at least one inner sheet nested in said outer sheet, said inner sheet folded along an inner fold line aligned with said outer fold line, said inner sheet having an outer pressure seal adhesive pattern juxtaposed with said first inner pressure seal adhesive pattern of said outer sheet, said juxtaposed adhesive patterns binding said sheets after being activated by a sealing pressure.

2. A booklet as in claim 1 wherein said pressure seal adhesives are activated by a sealing pressure force of 100 to 200 pounds per linear inch.

3. A booklet as in claim 1 wherein said inner sheet has a second inner pressure seal adhesive pattern on both sides of said fold line, said inner adhesive patterns are juxtaposed when said inner sheet is folded and said inner adhesive patterns bind together.

4. A booklet as in claim 3 wherein said outer adhesive pattern on the inner sheet does not overlap said second inner adhesive pattern on the other side of said inner sheet.

5. A booklet comprising a plurality of folded sheets nested together, each sheet comprising:

a fold line along which each sheet is folded, a first pressure seal adhesive pattern on an outer side of said sheet and a second adhesive pattern on an inner side of said sheet, said adhesive patterns being on both sides of said fold line, said adhesive pattern on the outer side of said sheet not overlapping said adhesive pattern on the inner side of said sheet, and said adhesive patterns on said inner and outer side of said sheet being juxtaposed when said plurality of folded sheets are nested together.

6. A booklet as in claim 5 wherein said adhesive patterns are strips parallel to said fold lines.

7. A booklet as in claim 6 wherein said adhesive patterns are continuous strips.

8. A booklet as in claim 6 wherein said adhesive patterns on one side of said sheet are offset from said fold line at least a distance equal to the distance from the fold line to the outer edge of the adhesive strip on the opposite side of said sheet.

9. A method for forming a booklet having a plurality of folded sheets nested together wherein each sheet has a pressure seal adhesive pattern offset from and on both sides of the sheet fold line, and the adhesive pattern on one side of the sheet does not overlap the adhesive pattern on the other side of the sheet, and forming the booklet using sheet feeders, accumulators, and folders, said method comprising:

a. printing information on the pages to be formed from the sheets having adhesive patterns, b. loading stacks of preprinted sheets having the adhesive pattern in a first arrangement of orientations in a first sheet feeder and loading stacks of preprinted sheets having a second arrangement of orientations in a second sheet feeder, c. feeding at least one sheet into each accumulator from each sheet feeder such that the fold line of each sheet is aligned over an outlet slot in one of the accumulators, d. folding each sheet along the fold line and pushing each sheet through the outlet slot of an accumulator, e. nesting an inner sheet into an outer sheet by inserting a folded sheet from one accumulator into a folding outer sheet being pushed through a second accumulator wherein the adhesive patterns on each sheet are juxtaposed with adhesive patterns on adjacent sheets, and f. binding the booklet by sealing under pressure the juxtaposed pressure adhesive patterns.

* * * * *